US011177615B2

(12) United States Patent
Ikehara

(10) Patent No.: US 11,177,615 B2
(45) Date of Patent: Nov. 16, 2021

(54) ELECTRICAL CONNECTOR

(71) Applicant: HIROSE ELECTRIC CO., LTD., Yokohama (JP)

(72) Inventor: Ken Ikehara, Yokohama (JP)

(73) Assignee: HIROSE ELECTRIC CO., LTD., Yokohama (JP)

( * ) Notice: Subject to any disclaimer, the term of this patent is extended or adjusted under 35 U.S.C. 154(b) by 0 days.

(21) Appl. No.: 17/010,946

(22) Filed: Sep. 3, 2020

(65) Prior Publication Data

US 2021/0083433 A1 Mar. 18, 2021

(30) Foreign Application Priority Data

Sep. 12, 2019 (JP) ..... JP2019-166267

(51) Int. Cl.
*H01R 13/58* (2006.01)
*H01R 13/6586* (2011.01)
*H01R 13/42* (2006.01)

(52) U.S. Cl.
CPC ..... *H01R 13/6586* (2013.01); *H01R 13/42* (2013.01)

(58) Field of Classification Search
CPC ... H01R 13/5812; H01R 13/595; H01R 35/02
USPC ..... 439/460, 469, 470, 472, 165, 652, 954, 439/582
See application file for complete search history.

(56) References Cited

U.S. PATENT DOCUMENTS 7,316,584 B2 * 1/2008 Mackillop ..... H01R 13/6463 439/607.05
8,894,448 B2 11/2014 Affeltranger

FOREIGN PATENT DOCUMENTS

DE 20 2015 103 479 8/2015
DE 10 2016 105 465 9/2017
JP 2014-502415 A 1/2014

OTHER PUBLICATIONS

European Search Report dated Feb. 3, 2021, 7 pages.

* cited by examiner

*Primary Examiner* — Phuong Chi Thi Nguyen
(74) *Attorney, Agent, or Firm* — Rankin, Hill & Clark LLP

(57) ABSTRACT

An electrical connector includes: terminal pairs to which wire pairs are attached; a terminal holding part made of insulating material and holding the terminal pairs; an outer shell made of electric conductive material and accommodating the terminal holding part and end portions of the wire pairs; a fitting part fitted to a counter connector; and a shield member disposed in the outer shell and made of electric conductive material. The shield member includes wire separation walls twisted around the axial center of the shield member. The wire separation walls separate the wire pairs for each wire pair, and two insulated wires of each wire pair are curved in the same direction as each other.

4 Claims, 8 Drawing Sheets

ELECTRICAL CONNECTOR

INCORPORATION BY REFERENCE

This application is based on and claims the benefit of priority from Japanese Patent application No. 2019-166267 filed on Sep. 12, 2019, which is incorporated by reference in its entirety.

TECHNICAL FIELD

The present invention relates to an electrical connector suitable for high-speed transmission of signals.

BACKGROUND ART

For high-speed transmission of signals between electrical/electronic devices containing a computer, a twisted pair cable is well used. For example, an 8-wire 4-pair unshielded twisted pair (UTP) cable is used in Gigabit Ethernet which is popular at present. As a connector used for connecting a twisted pair cable for Ethernet to an electrical/electronic device, an 8P8C modular connector is widely used, but, for example, in order to be adapted for usage in an industrial machinery field, another type connector for a twisted pair cable is also known, which is enhanced in robustness or has a water-proof function or a rigid lock function (for example, see Japanese Unexamined Patent Application Publication (Translation of PCT Application) 2014-502415).

SUMMARY OF THE INVENTION

Recent years, with increasing of communication speed, such as the spread of 10 Gigabit Ethernet, the degrees of noise resistant properties required for a twisted pair cable and a connector for a twisted pair cable are increased. Depending on such requirements, regarding a twisted pair cable, a shielded twisted pair (STP) cable is already spread, in which four wire pairs of an 8-wire 4-pair cable are shielded with metallic foils or the like for each wire pair, and then the whole of the four wire pairs are shielded by a braid or braided shield, for example.

On the other hand, regarding a connector for a twisted pair cable, when a connector for an 8-wire 4-pair STP cable is taken as an example, in order to increase a noise resistant performance, it is considered to adopt the following configuration.

That is, the outer protective sheath of the end portion of an STP cable is cut off, the exposed braid is folded back or bundled into one, and then the metallic foils covering the exposed four pairs of insulated wires are cut off. Then, after the four pairs of insulated wires are untwisted and then subjected to terminal processing, the four pairs of insulated wires are connected to four pairs of terminals. Then, the four pairs of terminals are held with each terminal insulated using an insulating member, and the four pairs of terminals and the end portions of the four pairs of insulated wires connected to the four pairs of terminals are accommodated in an electric conductive cylindrical outer shell (housing). Furthermore, separators which separates the four pairs of terminals for each pair and the end portions of the four pairs of insulated wires for each pair so as to correspond to each pair of insulated wires of the STP cable are formed or placed in the outer shell. Additionally, the folded or bundled braid of the STP cable is electrically connected to the outer shell. Furthermore, the four pairs of terminals held by the insulating member are fixed in the axially tip end portion of the outer shell, and the folded portion of the braid or the tip end portion of the protective sheath in the end portion of the STP cable is fixed in the axial opposite end portion of the outer shell. The end portions of the four pairs of insulated wires connected to the four pairs of terminals are disposed in the axial middle portion of the outer shell.

However, in the connector having the above configuration, in each of any pairs of insulated wires among the four pairs of insulated wires, one insulated wire and the other insulated wire may be accommodated in the outer shell in a state where they are warped in different directions from each other. That is, the inside of the outer shell is divided by the separator into four spaces extending linearly in the axial direction, and one pair of terminals is accommodated in each space. When the STP cable is attached to the connector, the two insulated wires composing one pair may be warped in different directions from each other in one divided space, and these wires are accommodated in this state. The warps of two insulated wires composing one pair occur when the length of the pair of insulated wires disposed in the axial middle portion of the outer shell is longer than the distance between one pair of terminals fixed to the axial tip end portion of the outer shell and the folded portion of the braid or the tip end portion of the protective sheath fixed to the axial opposite end portion of the outer shell.

In a case where two insulated wires composing one pair are accommodated in the outer shell in a state where they are warped in different directions from each other, the distance between the two insulated wires becomes ununiform in the outer shell. As a result, electric properties of the connector, such as an insertion loss or a reflection loss, may be deteriorated.

The present invention is made in view of the above described problems, and an object of the present invention is to provide an electrical connector which is capable of suppressing deteriorating electric properties caused by warping of paired insulated wires in different directions from each other in an outer shell.

To achieve the object, the present invention is an electrical connector used for a cable including a plurality of wire pairs each including a pair of insulated wires, the electrical connector comprising: a plurality of terminal pairs each including a pair of terminals and to which the wire pairs are attached; a terminal holding part made of insulating material and holding the terminal pairs; an outer shell made of electric conductive material and formed into a cylindrical shape, wherein the terminal holding part holding the terminal pairs is disposed on one side in an axial direction in the outer shell and the wire pairs attached to the terminal pairs are disposed on another side in the axial direction in the outer shell; a fitting part disposed on said one side in the axial direction in the outer shell to be fitted to a counter connector; and a shield member disposed in the outer shell and made of electric conductive material, wherein the shield member separates the wire pairs for each wire pair in the outer shell, and forms extending shape of each of the wire pairs such that one insulated wire and another insulated wire in each of the wire pairs are curved in a same direction as each other.

In the above electrical connector of the present invention, the shield member may include: an axial part extending in the axial direction of the outer shell; and a plurality of wire separation walls extending radially from the axial part and separating the wire pairs for each wire pair in the outer shell, and the wire separation walls may be twisted in a same direction as each other around the axial part.

In the above electrical connector of the present invention, a twisting angle of each of the wire separation walls per a unit length may be approximately equal to a twisting angle of each of the wire pairs per the unit length in the cable.

In the above electrical connector of the present invention, the shield member may be formed into a columnar shape extending in the axial direction of the outer shall, a plurality of accommodating grooves each extending in an axial direction of the shield member may be formed on an outer circumferential face of the shield member, the wire pairs may be disposed in the accommodating grooves separately for each wire pair, and the accommodating grooves may be twisted in a same direction as each other around an axial center of the shield member.

In the above electrical connector of the present invention, a twisting angle of each of the accommodating grooves per a unit length may be approximately equal to a twisting angle of each of the wire pairs per the unit length in the cable.

In the above electrical connector of the present invention, the terminal holding part may be divided into a plurality of terminal holding pieces holding the terminal pairs separately for each terminal pair, and the shield member may include a plurality of terminal separation walls which separates the terminal holding pieces for each terminal holding piece.

Effect of the Invention

According to the present invention, it becomes possible to suppress deteriorating electric properties of the electrical connector due to warping of the paired insulated wires in different directions from each other in the outer shell.

DETAILED DESCRIPTION

Figure 1:
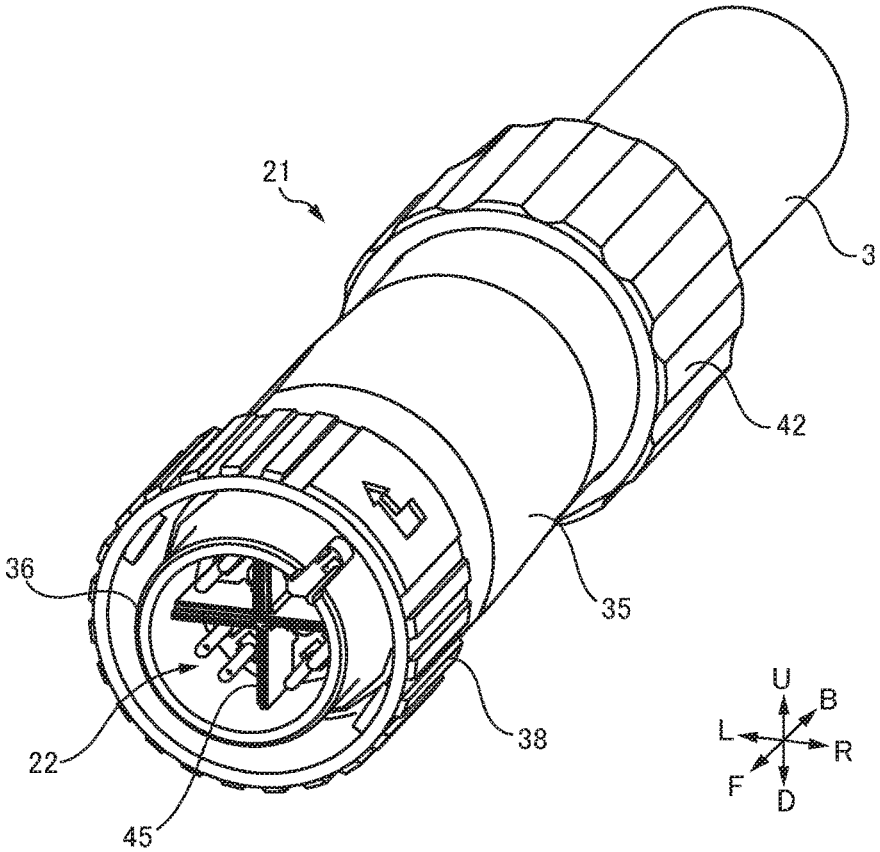
FIG. 1 is a perspective view showing the appearance of a connector according to one embodiment of the present invention.
Figure 2:
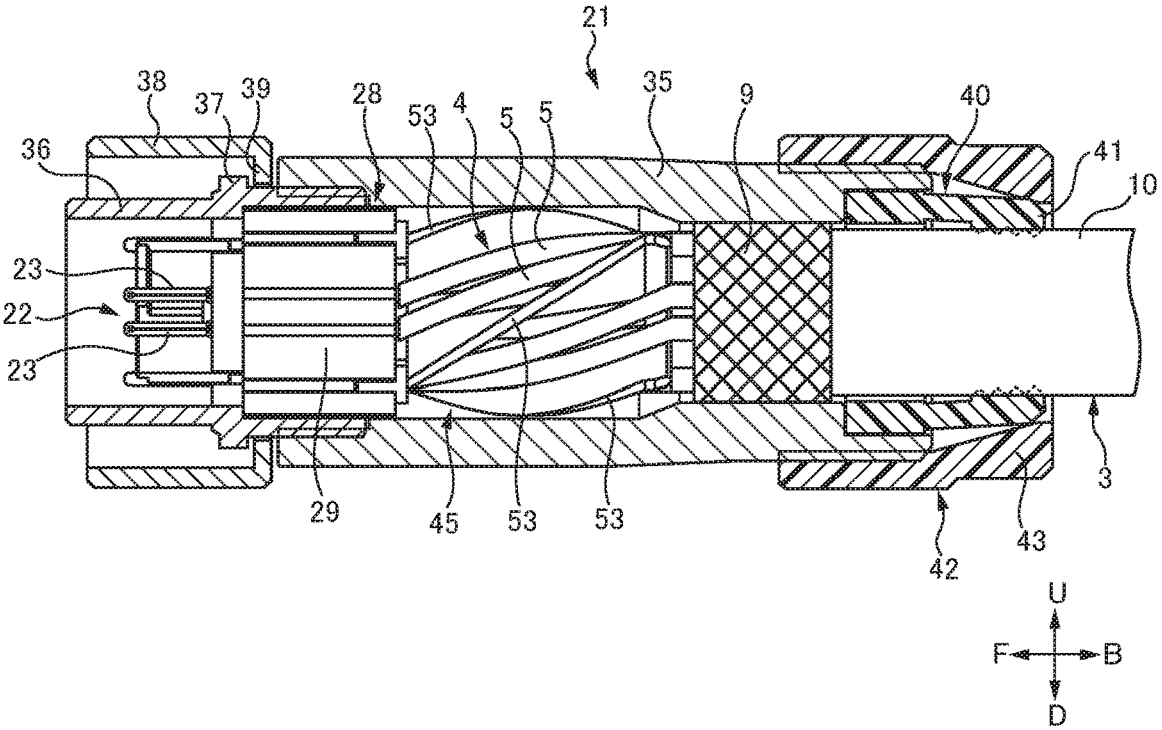
FIG. 2 is a sectional view showing the connector according to the embodiment of the present invention.
Figure 3:
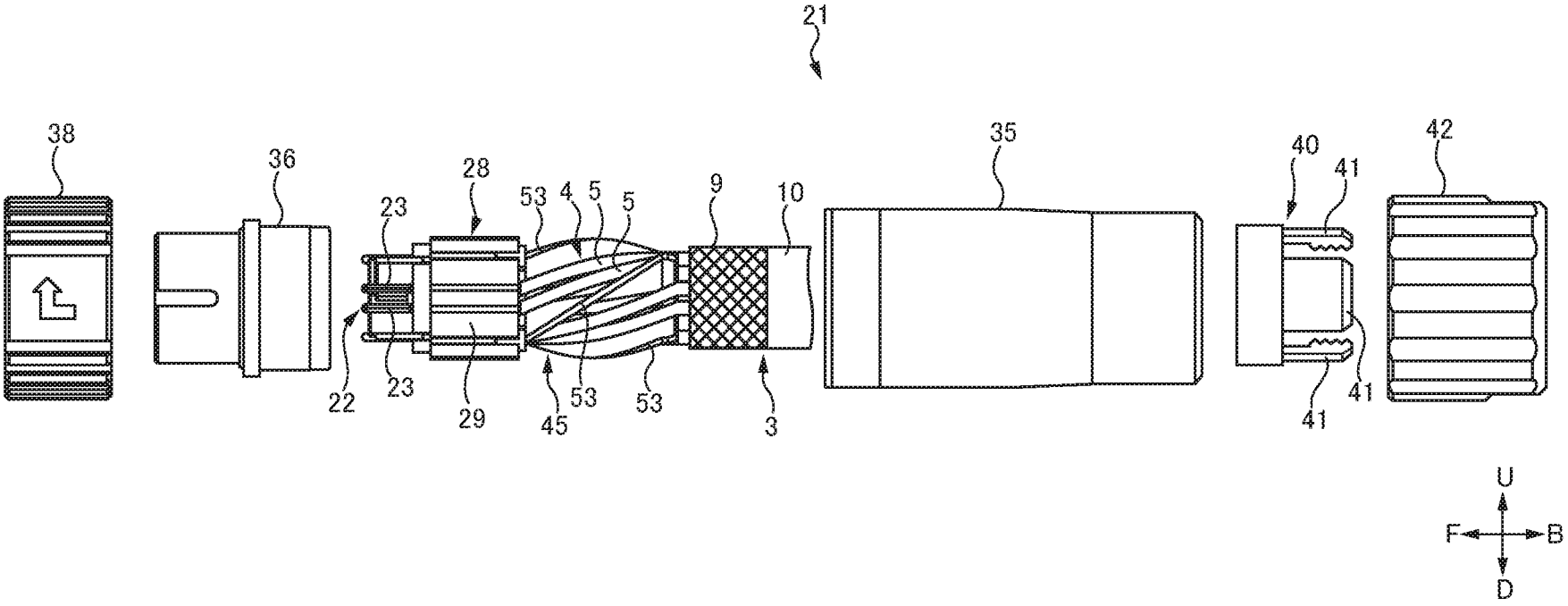
FIG. 3 is a disassembled view showing the connector according to the embodiment of the present invention.
Figure 4:
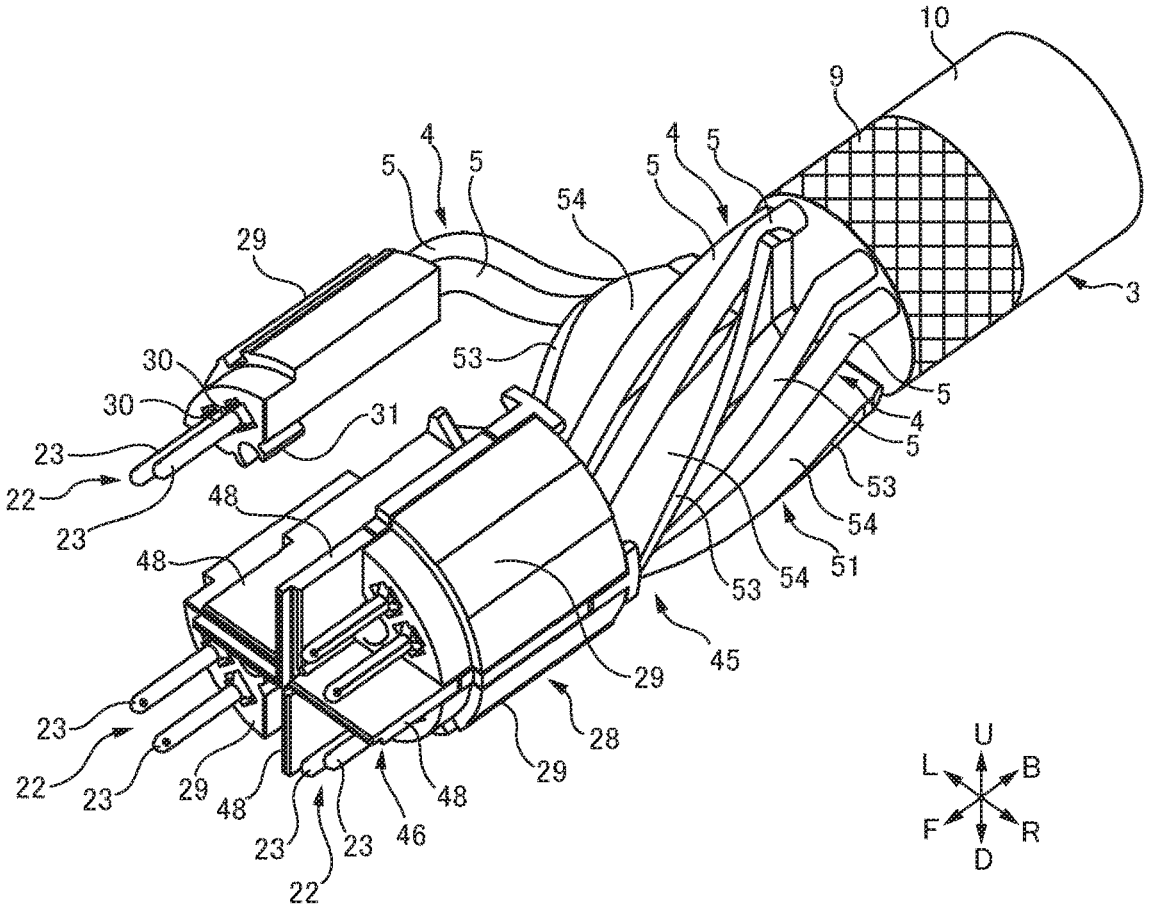
FIG. 4 is a perspective view showing terminal pairs, wire pairs, a shield member and the others, when viewed from the front right upper side, in the connector according to the embodiment of the present invention.
Figure 5:
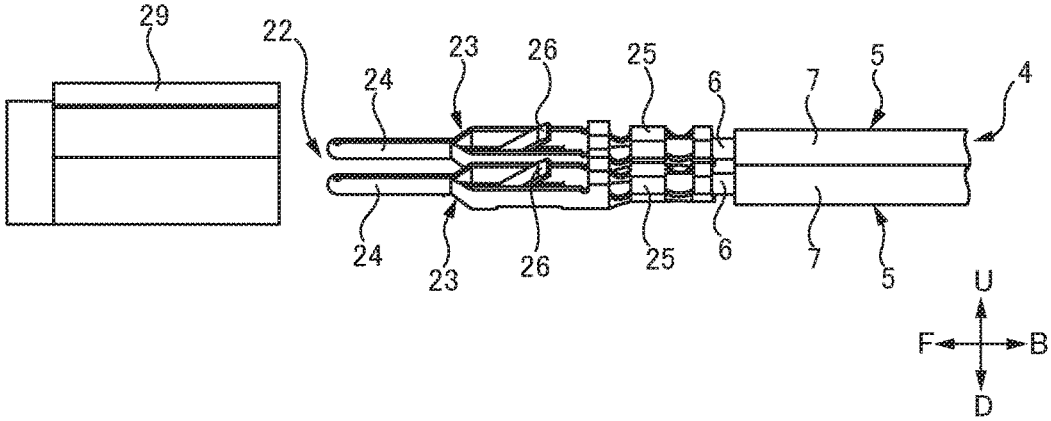
FIG. 5 is a disassembled view showing the terminal pair and a terminal holding piece in the connector according to the embodiment of the present invention.
Figure 6:
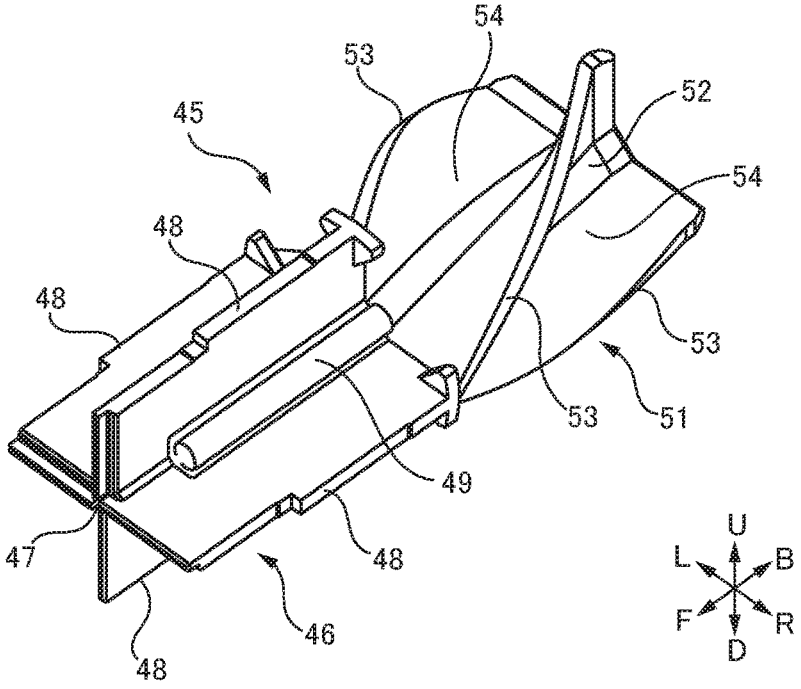
FIG. 6 is a perspective view showing the shield member, when viewed from the front right upper side, in the connector according to the embodiment of the present invention.
Figure 7:
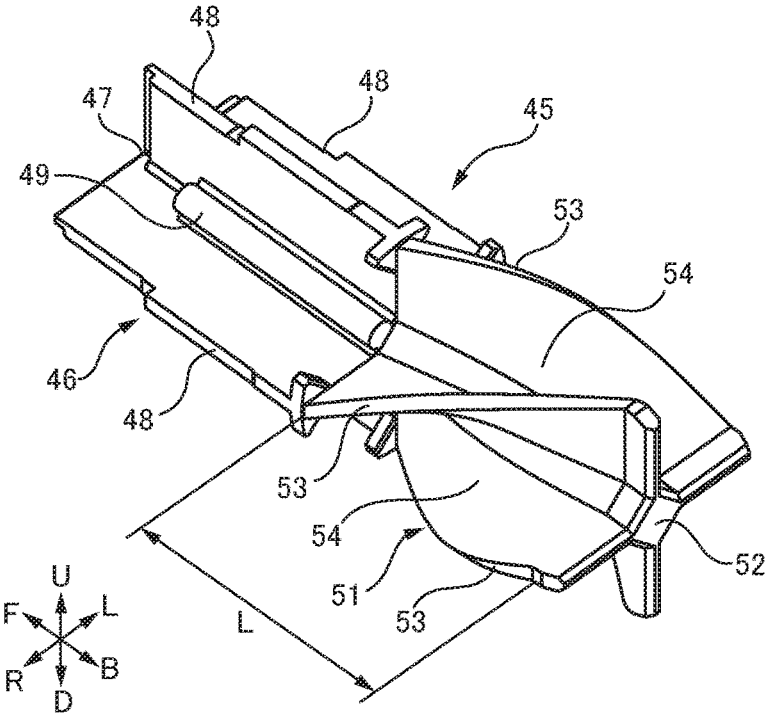
FIG. 7 is a perspective view showing the shield member, when viewed from the rear right upper side, in the connector according to the embodiment of the present invention.
Figure 8:
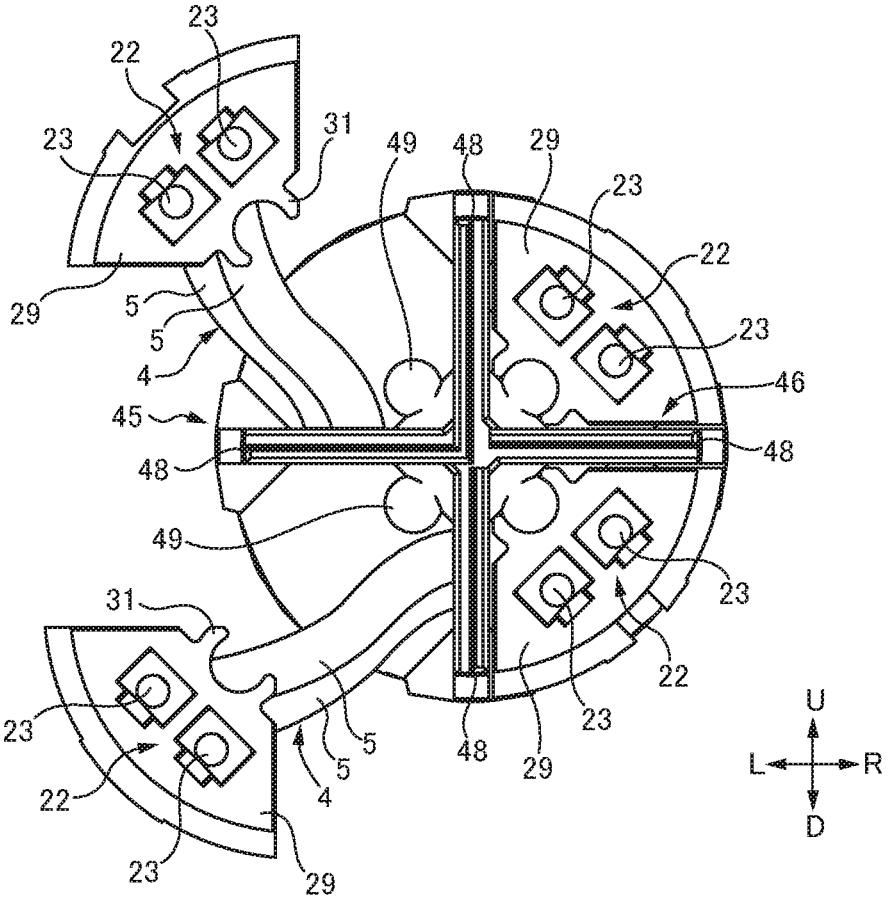
FIG. 8 is a diagram showing the terminal pairs, the wire pairs, the shield member and the others, when viewed from the front side, in the connector according to the embodiment of the present invention.
Figure 9:
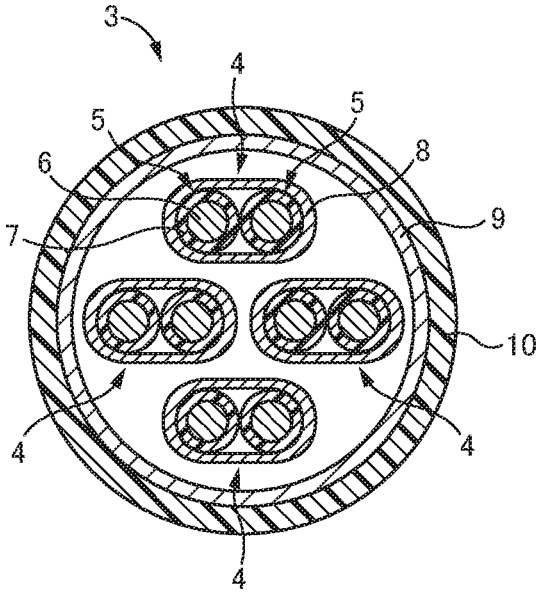
FIG. 9 is a diagram schematically showing a cross section of a cable.

FIG. 1 is a perspective view showing the appearance of a connector 21 as one embodiment of an electrical connector of the present invention, FIG. 2 is a sectional view showing the section of the connector 21 cut by a plane containing its axial line, and FIG. 3 is a disassembled view showing the connector 21. FIG. 4 is a perspective view showing terminal pairs 22, wire pairs 4, a shield member 45 and the others, when viewed from the front right upper side. In FIG. 4, for convenience for explanation, one terminal holding piece 29 is separated away from the shield member 45. FIG. 5 is a disassembled view showing the terminal pair 22 and the terminal holding piece 29. FIG. 6 and FIG. 7 are perspective views showing the shield member 45 when viewed from the front right upper side and the rear right upper side, respectively. FIG. 8 is a view showing the terminal pairs 22, the wire pairs 4, the shield member 45 and the others, when viewed from the front side. In FIG. 8, for convenience for explanation, the two terminal holding pieces 29 are separated away from the shield member 45. FIG. 9 is a diagram schematically showing a cross section of a cable 3. The arrows marked in the lower portions of FIG. 1 to FIG. 8 and FIG. 12 show the front side (F), the rear side (B), the upper side (U), the lower side (D), the left side (L) and the right side (R) of the connector 21.

In FIG. 1, the connector 21 is a plug for an 8-wire 4-pair twisted pair cable. The connector 21 is attached to an end portion of a cable 3. The cable 3 is an 8-wire 4-pair STP cable. As shown in FIG. 9, the cable 3 includes four wire pairs 4 each containing one pair of insulated wires 5. Each insulated wire 5 has an inner conductor 6 and an insulation 7 covering the outer circumference of the inner conductor 6. The two insulated wires 5 forming each wire pair 4 are twisted together. Each wire pair 4 is shielded individually. Specifically, the outer circumference of each wire pair 4 is covered with a metallic foil 8 made of copper or aluminum, for example. The whole of the four wire pairs 4 are shielded. Specifically, the outer circumference of the bundle of the four wire pairs 4 is covered with a braid 9 made of metal such as copper, for example. The outer circumference of the braid 9 is covered with a protective sheath 10 made of insulating material.

As shown in FIG. 3 and FIG. 4, the connector 21 includes four terminal pairs 22, a terminal holding part 28, a shield member 45, a shell 35, a fitting part 36, a sleeve 38, a cable cramp 40 and a fastening ring 42.

As shown in FIG. 5, each terminal 23 forming the terminal pair 22 is made of electric conductive material such as metal. Each terminal 23 has a contact part 24 coming into contact with a counter connector, a connection part 25 connecting the inner conductor 6 of the insulated wire 5, and an engagement part 26 engaging the terminal 23 in a terminal holding piece 29.

The contact part 24 is formed in the front end portion of the terminal 23. The contact part 24 in the present embodiment is a male type and formed into a pin-like shape, but a cylindrical female type may be used as the contact part 24.

To the connection part 25, the inner conductor 6 of the insulated wire 5 is crimped. Specifically, to the connection part 25, the end portion of the inner conductor 6 of the insulated wire 5, where is subjected to terminal processing such that the insulation 7 is stripped, is caulked and fixed. The inner conductor 6 may be connected to the connection part 25 by soldering.

The engagement part 26 is protruded outward from the approximately center portion of the terminal 23 in the front and rear directions. When the terminal 23 is inserted into a terminal insertion hole 30 (see FIG. 4) of the terminal holding piece 29, the protruding end portion of the engagement part 26 is engaged with a recess part or a step part formed on the inner face of the terminal insertion hole 30, for example, and then the terminal 23 is held by the terminal holding piece 29.

As shown in FIG. 4, the terminal holding part 28 has a function of holding the eight terminals 23 of the connector 21 in the shell 35 while insulating them from each other and also insulating them from the shield member 45. The terminal holding part 28 is divided into four terminal holding pieces 29 of which number corresponds to the number of terminal pairs 22 of the connector 21. One terminal pair 22 is held by one terminal holding piece 29.

Each terminal holding piece 29 is made of insulating material, such as resin, and formed into a columnar shape whose cross section is shaped like a fan. Each terminal holding piece 29 has two terminal insertion holes 30 penetrating through the terminal holding piece 29 in the front and rear directions. Into the terminal insertion holes 30, the two terminals 23 forming the terminal pair 22 are inserted from the rear side. Each terminal 23 penetrates the terminal holding piece 29 through the terminal insertion hole 30, and the contact part 24 of each terminal 23 is protruded forward from the front face of the terminal holding piece 29. Additionally, each terminal holding piece 29 has an engagement part 31 for fixing the terminal holding piece 29 to the shield member 45 (see FIG. 8).

As shown in FIG. 2, the shell 3 has a function as an outer shell of the connector 21, and a function as a shield for the whole of the four terminal pairs 22 and the end portions of the four wire pairs 4 attached to the four terminal pairs 22. The shell 35 is made of electric conductive material such as metal, and formed into a circular cylindrical shape, for example. Inside the front end portion of the shell 35, the four terminal holding pieces 29 holding the four terminal pairs 22 are disposed. Inside the middle portion of the shell 35 in the front and rear directions, the end portions of the four wire pairs 4 are disposed. Inside the rear end portion of the shell 35, the folded portion of the braid 9 and the end portion of the cable 3 near the folded portion of the braid 9 are disposed. The braid 9 of the cable 3 comes into contact with the inner face of the rear end portion of the shell 35, and the braid 9 and the shell 35 are thus electrically connected to each other. The shell 35 is an example of "an outer shell".

The fitting part 36 is a part into which the counter connector is fitted. The fitting part 36 is made of electric conducive material such as metal, formed into a circular cylindrical shape, for example, and attached to the front end portion of the shell 35. Screws are formed on the inner face of the front end portion of the shell 35 and on the outer face of the rear end portion of the fitting part 36, and the shell 35 and the fitting part 36 are coupled with each other by the screws. The shell 35 and the fitting part 36 are electrically connected to each other. The front portions of the four terminal holding pieces 29 holding the four terminal pairs 22 are positioned inside the fitting part 36 coupled with the shell 35. The contact part 24 of each terminal 23 protruded forward from each terminal holding piece 29 is positioned inside the front portion of the fitting part 36.

The sleeve 38 is formed into a circular cylindrical shape, and provided around the outer circumference of the fitting part 36. The sleeve 38 is rotatable with respect to the fitting part 36. The sleeve 38 is supported so as not to fall out from the fitting part 36. The sleeve 38 has a decreased diameter portion 39 formed in its rear end portion. The decreased diameter portion 19 is inserted between a flange portion 37 formed in the fitting part 36 and the front end portion of the shell 35. The sleeve 38 includes a lock mechanism for locking the connector 21 and the counter connector together. The connector 21 in the present embodiment and the counter connector adopt a bayonet type lock mechanism, but may adopt a screw type lock mechanism.

The cable clamp 40 and the fastening ring 42 are members to fix the end portion of the cable 3 to the shell 35, made of resin material, for example, and provided in the rear end portion of the shell 35. The cable clamp 40 is inserted into the rear end portion of the shell 35. Clamp pieces 41 are formed in the rear portion of the cable clamp 40. Screws are formed on the outer face of the rear end portion of the shell 35 and on the inner face of the front end portion of the fastening ring 42, and the shell 35 and the fastening ring 42 are coupled with each other by the screws. The fastening ring 42 has a diameter-decreased fastening part 43 in its rear end portion. By rotating the fastening ring 42 in a direction in which it is coupled with the shell 35, the fastening part 43 pushes each clamp piece 41 inward, and notches formed on the inner face of each clamp piece 41 bite into the outer face of the protective sheath 10 of the cable 3. Then, the cable 3 is fixed to the shell 35.

As shown in FIG. 2, the shield member 45 is disposed inside the shell 35. The shield member 45 is made of electric conductive material such as metal. The shield member 45 has the following three functions (1) to (3): (1) a function of shielding the four terminal pairs 22 for each terminal pair 22 by separating the four terminal holding pieces 29 holding the four terminal pairs 22 for each terminal holding piece 29 in the shell 35; (2) a function of shielding the end portions of the four wire pairs 4 for each wire pair 4 by separating the end portions of the four wire pairs 4 attached to the four terminal pairs 22 for each wire pair 4 in the shell 35; and (3) a function of forming extending shapes of one insulated wire 5 and the other insulated wire 5 of each wire pair 4 such that one insulated wire 5 and the other insulated wire 5 of each wire pair 4 are curved in the same direction as each other in the shell 35.

As shown in FIG. 6 and FIG. 7, the shield member 45 includes a terminal separation part 46 and a wire separation part 51. The terminal separation part 46 performs the above function (1), and is formed in the front portion of the shield member 45. The wire separation part 51 performs the above functions (2) and (3), and is formed in the rear portion of the shield member 45.

The terminal separation part 46 has an axial part 47 and four terminal separation walls 48. The axial part 47 is disposed such that its axial line is coincident with the axial line of the shell 35. The axial part 47 extends in the front and rear directions. The four terminal separation walls 48 extend radially from the axial part 47. The four terminal separation walls 48 are disposed at 90 degrees intervals in the circumferential direction. Furthermore, the four terminal separation walls 48 extends linearly in the front and rear directions.

The four terminal separation walls 48 separate the four terminal holding pieces 29 holding the four terminal pairs 22 for each terminal holding piece 29 in the shell 35. That is, as shown in FIG. 4, each terminal separation wall 48 is disposed between the two terminal holding pieces 29 adjacent to each other and separates the two terminal holding pieces 29 from each other. Additionally, each terminal separation wall 48 is disposed between one pair of contact parts 24 and the other pair of contact parts 24 adjacent to each other, which protrude forward from the two adjacent terminal holding pieces 29, and separates the two pairs of contact parts 24 form each other. The two terminal pairs 22 adjacent to each other are magnetically shielded by the terminal separation wall 48 disposed between them. In the above manner, the four terminal separation walls 48 shield the four terminal pairs 22 for each terminal pair 22.

Each terminal holding piece 29 is attached between the two terminal separation walls 48 adjacent to each other. Specifically, as shown in FIG. 8, in the terminal separation part 46, a projection-shaped attachment part 49 having a circular cross section is formed between the two terminal separation walls 48 adjacent to each other. The terminal holding piece 29 is fixed between the two terminal separation walls 48 adjacent to each other by engaging the engagement part 31 with the attachment part 49.

As shown in FIG. 7, the wire separation part 51 has an axial part 52 and four wire separation walls 53. The axial part 52 extends in the front and rear directions, and the axial line of the axial part 52 is coincident with the axial line of the shell 35 and the axial line of the axial part 47. The four wire separation walls 53 extend radially from the axial part 52. The four wire separation walls 53 are disposed at 90 degrees intervals in the circumferential direction. The front end portions of the four wire separation walls 53 are coupled with the rear end portions of the four terminal separation walls 48 each other. In the present embodiment, each wire separation wall 53 and each terminal separation wall 48 are continuously formed. The four wire separation walls 53 are twisted from their front end portions to their rear end portions in the same direction as each other around the axial part 52. In the connector 21 in the present embodiment, as shown in FIG. 6, when the connector 21 is viewed from the front side, the four wire separation walls 53 are twisted in the counterclockwise direction by 90 degrees around the axial part 52.

As shown in FIG. 4, the four wire separation walls 53 separate the four wire pairs 4 for each wire pair 4 in the shell 35. That is, each wire separation wall 53 extends radially from the axial part 52 toward the shell 35, and the end face on the extending end side of each wire separation wall 53 is extremely close to the inner face of the shell 35 (see FIG. 2). As a result, the inner space of the middle portion of the shell 35 in the front and rear directions is divided into four wire accommodating rooms 54 by the four wire separation walls 53. Then, in each wire accommodating room 54, the end portions of the two insulated wires 5 forming one wire pair 4 are disposed. In the shell 35, the wire separation wall 53 is disposed between the two wire pairs 4 adjacent to each other, and the two wire pairs 4 are separated from each other by the wire separation wall 53. In the shell 35, the two wire pairs 4 adjacent to each other are magnetically shielded by the wire separation wall 53 disposed between them. In the above manner, the four wire separation walls 53 shield the four wire pairs 4 for each wire pair 4 in the shell 35.

The four wire separation walls 53 are twisted in the same direction as each other around the axial part 52, such that the four wire accommodating rooms 54 are curved from the front end to the rear end of the wire separation part 51. That is, each wire accommodating room 54 is formed into a curved long space. By disposing the end portion of the wire pair 4 in each wire accommodating room 54, the end portion of each wire pair 4 is curved along the curved wire accommodating room 54. By disposing the end portions of the two insulated wires forming each wire pair 4 in one curved long wire accommodating room 54, the end portions of the two insulated wires 5 are curved in the same direction as each other at the same degrees as each other in the shell 35. In the above manner, the four wire separation walls 53 are twisted in the same direction around the axial part 52, so that the extending shapes of the two insulated wires 5 forming each wire pair 4 are formed such that the two insulated wires 5 are curved in the same direction as each other. As a result, from the front end to the rear end of the wire separation part 51, the distance between the two insulated wires 5 forming each wire pair 4 becomes substantially uniform.

Additionally, the twisting direction of each wire separation wall 53 is the same as the twisting direction of each wire pair 4 in the cable 3. The twisting angle of each wire separation wall 53 per a unit length is set to be substantially equal to the twisting angle of each wire pair 4 per the unit length in the cable 3. That is, in the cable 3, the two insulated wires 5 forming each wire pair 4 are twisted each other, and moreover, the four wire pairs 4 each covered with the metal foil 8 are twisted each other. The four wire pairs 4 are twisted in the same direction. In the present embodiment, the twisting direction of each wire pair 4 in the cable 3 is the counterclockwise direction when viewing the end face of the end portion of the cable 3 from the front. The twisting angle of each wire pair 4 per L mm in length of the cable 3 is approximately 90 degrees. Therefore, as shown in FIG. 6, the twisting direction of each wire separation wall 53 is set to the counterclockwise direction. As shown in FIG. 7, the length of the wire separation part 51 in the front and rear direction is set to L mm, and the twisting angle of each wire separation wall 53 from the front end to the rear end of the wire separation part 51 is set to 90 degrees.

A way to attach the cable 3 to the connector 21 will be described as follows, for example. Firstly, after the end portion of the cable 3 is passed through the fastening ring 42, the cable clamp 40 and the shell 35, the protective sheath 10 of the end portion of the cable 3 is cut off so that the braid 9 is exposed, the exposed braid 9 is folded so that the end portions of the four wire pairs 4 are exposed. Then, the end portions of the four wire pairs 4 are untwisted, and the metal foils 8 are cut off from the end portions of the four wire pairs 4. Then, the two insulated wires 5 of each wire pair 4 are untwisted, and the insulation 7 of the end portion of each insulated wire 5 is stripped.

Next, the terminals 23 are attached to the end portions of the two insulated wires 5 of each wire pair 4. Next, the two terminals 23 attached to the end portions of the two insulated wires 5 of each wire pair 4 are inserted into the two terminal insertion holes 30 formed in the terminal holding piece 29. As a result, the terminal holding piece 29 is attached to the end portion of each wire pair 4.

Next, the end portion of one wire pair 4 among the four wire pairs 4 is disposed in the wire accommodating room 54 between the wire separation walls 53 of the shield member 45. At this time, the end portion of the wire pair 4 is disposed along the curved wire accommodating room 54. Then, the terminal holding piece 29 attached to the end portion of the wire pair 4 is attached between the terminal separation walls 48 of the shield member 45 by engaging the engagement part 31 with the attachment part 49. As a result, the end portion of the wire pair 4 and the terminal holding piece 29 attached to the end portion of the wire pair 4 are attached to the shield member 45. The same work as the above work is repeated for the remaining three wire pairs 4, and the end portions of the three wire pairs 4 and the terminal holding pieces 29 attached to the three wire pairs 4 are attached to the shield member 45.

Next, the shield member 45 to which the four terminal holding pieces 29 and the end portions of the four wire pairs 4 are attached, and the end portion of the cable 3 including the folded portion of the braid 9 are inserted into the shell 35, and then, the sleeve 38 and the fitting part 36 are attached to the front end portion of the shell 35. Next, the cable clamp 40 is attached to the rear end portion of the shell 35, and the fastening ring 42 is fastened to the rear end portion of the shell 35. Then, the shield member 45 to which the four terminal holding pieces 29 and the end portions of the four wire pairs 4 are attached, and the end portion of the cable 3 including the folded portion of the braid 9 are accommodated and fixed in the shell 35. As a result, the cable 3 is attached to the connector 21.

As described above, the shield member 45 of the connector 21 in the embodiment of the present invention includes the wire separation part 51 which separates the four wire pairs 4 for each wire pair 4 in the shell 35 and forms the extending shapes of the two insulated wires 5 of each wire pair 4 such that the two insulated wires 5 of each wire pair 4 are curved in the same direction as each other in the shell 35. The wire separation part 51 forms the extending shapes of the two insulated wires 5 forming each wire pair 4 such that the two insulated wires 5 of each wire pair 4 are curved in the same direction as each other in the shell 35, so that the warping directions of the two insulated wires 5 forming each wire pair 4 can be the same as each other in the shell 35. Accordingly, when the cable 3 is attached to the connector 21, even if the two insulated wires 5 forming the wire pair 4 are warped in the shell 35, it becomes possible to suppress deteriorating electric properties of the connector 21, such as an insertion loss and a reflection loss. The effect will be described in detail with reference to FIG. 10A to FIG. 10D and FIG. 11A to FIG. 11C.

Figure 10A:
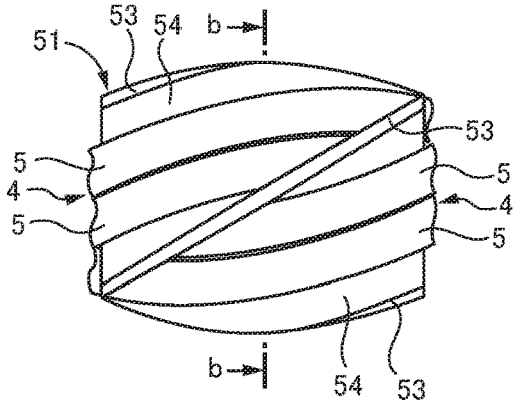
FIG. 10A is a diagram explaining an effect of the connector according to the embodiment of the present invention.
Figure 10B:
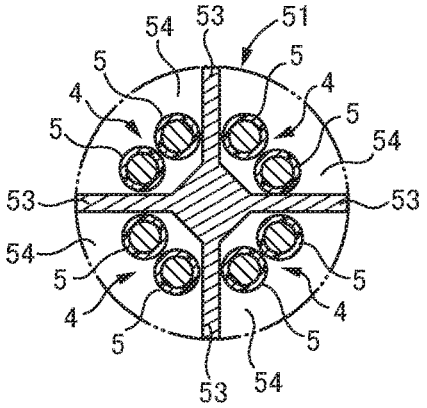
FIG. 10B is a diagram explaining an effect of the connector according to the embodiment of the present invention.
Figure 10C:
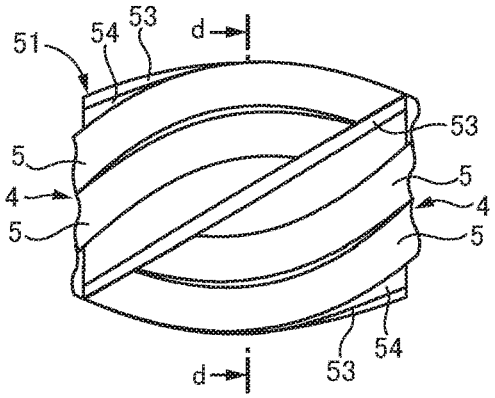
FIG. 10C is a diagram explaining an effect of the connector according to the embodiment of the present invention.
Figure 10D:
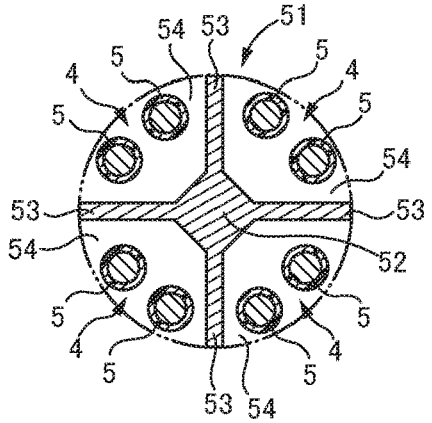
FIG. 10D is a diagram explaining an effect of the connector according to the embodiment of the present invention.

FIG. 10A shows a state where the insulated wires of the wire pairs 4 are disposed in the wire accommodating rooms 54 of the wire separation part 51 of the shield member 45 almost without being warped. FIG. 10B shows the sections of the wire separation part and the insulated wires 5, when cutting the wire separation part 51 and the insulated wires 5 at the position marked in FIG. 10A and viewing them from the arrows b-b in FIG. 10A. FIG. 10C shows a state where the insulated wires 5 of the wire pairs 4 are disposed in the wire accommodating rooms 54 of the wire separation part 51 in a warped state. FIG. 10D shows the sections of the wire separation part 51 and the insulated wires 5, when cutting the wire separation part 51 and the insulated wires 5 at the position marked in FIG. 10C and viewing them from the arrows d-d in FIG. 10C.

When the cable 3 is attached to the connector 21, as described above, the protective sheath 10 of the end portion of the cable 3 is cut off, the end portion of the braid 9 is folded, the metal foils 8 are cut off from the exposed end portions of the four wire pairs 4, the two insulated wires 5 of each wire pair 4 are untwisted, and then the insulation 7 of the end portion of each insulated wire 5 is stripped. At this time, the length of each insulated wire 5 exposed from the end portion of the protective sheath 10 by folding back the braid 9 is adjusted to a suitable length. That is, if the length of each insulated wire 5 is too short, when the two insulated wires 5 forming each wire pair 4 are disposed in the wire accommodating room 54 of the wire separation part 51, the terminal holding piece 29 attached to the end portion of each wire pair 4 does not reach the terminal separation part 46, and it becomes impossible to attach each terminal holding piece 29 to the terminal separation part 46. In this case, it is required to restart the attachment work of the cable 3 to the connector 21. On the other hand, if the length of each insulated wire 5 is too long, at a stage where the attachment of the cable 3 to the connector 21 is completed, each insulated wire 5 is warped in the shell 35. To prevent the occurrence of the above situations, the length of each insulated wire 5 is adjusted suitably. However, in a work site where the cable 3 is attached to the connector 21, in order to avoid the restarting the attachment work due to each insulated wire 5 having too short length, the length of each insulated wire 5 may be adjusted to be slightly longer than a suitable length.

In a case where each insulated wire 5 has a suitable length, as shown in FIG. 10A and FIG. 10B, each insulated wire 5 of each wire pair 4 is disposed in the wire accommodating room 54 of the wire separation part 51 almost without being warped. As a result, the distance between the two insulated wires 5 forming each wire pair 4 is almost uniform from the front end to the rear end of the wire accommodating room 54. Additionally, the distance between the wire pairs 4 adjacent to each other is almost uniform from the front ends to the rear ends of the wire accommodating rooms 54.

On the other hand, in a case where each insulated wire 5 is too long, as shown in FIG. 10C and FIG. 10D, each insulated wire 5 of each wire pair 4 is disposed in the wire accommodating room 54 of the wire separation part 51 in a warped or loosened state. However, because the wire separation part 51 forms the extending shapes of the two insulated wires 5 forming each wire pair 4 in the shell 35 such that the two insulated wires 5 are curved in the same direction as each other, the two insulated wires 5 forming each wire pair 4 are warped or loosened substantially in the same direction as each other in the shell 35. As a result, even if the two insulated wires 5 forming each wire pair 4 are warped or loosened, the distance between these insulated wires 5 is almost uniform from the front end to the rear end of the wire accommodating room 54, and the distance between the two wire pairs 4 adjacent to each other is almost uniform from the front ends to the rear ends of the wire accommodating rooms 54.

As described above, according to the connector 21 in the embodiment of the present invention, even if the two insulated wires 5 forming the wire pair 4 are warped in the shell 35, it becomes possible to keep uniformity of the distance between these insulated wires 5. That is, according to the connector 21, it is possible to prevent the insulated wires 5 forming the wire pair 4 from being warped in different directions from each other in the shell 35. Accordingly, it becomes possible to suppress deteriorating electric properties of the connector 21, such as an insertion loss and a reflection loss, due to warping of the two insulated wires 5 forming the wire pair 4 in different directions from each other in the shell 35. Additionally, according to the connector 21 in the embodiment of the present invention, if the insulated wire 5 is warped in the shell 35, it becomes possible to keep uniformity of the distance between the wire pairs 4. Accordingly, it becomes possible to suppress deteriorating electric properties of the connector 21, such as an insertion loss and a reflection loss, due to warping of the insulated wire 5 in the shell 35.

Figure 11A:
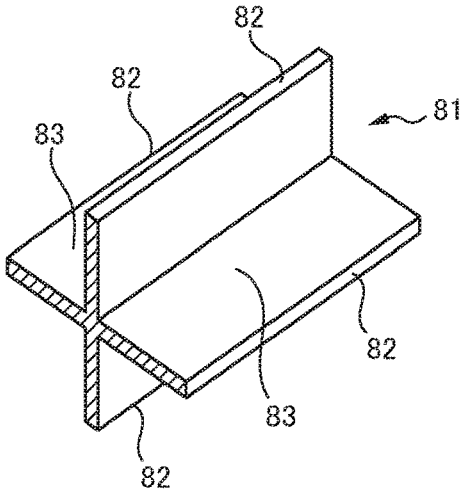
FIG. 11A is a diagram explaining a wire separation part of a shield member and its defect in a comparative example.
Figure 11B:
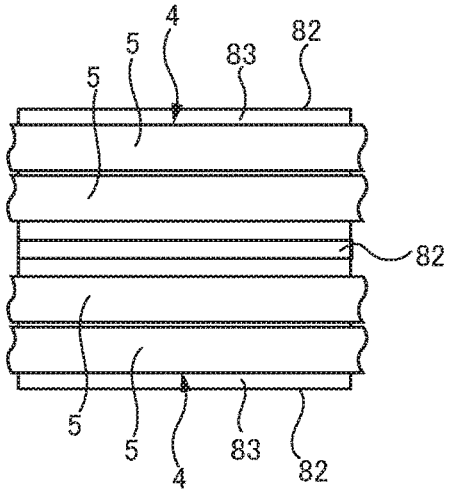
FIG. 11B is a diagram explaining the wire separation part of the shield member and its defect in the comparative example.
Figure 11C:
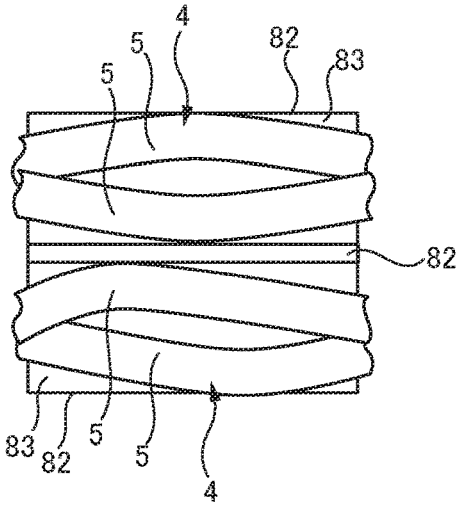
FIG. 11C is a diagram explaining the wire separation part of the shield member and its defect in the comparative example.
Figure 12:
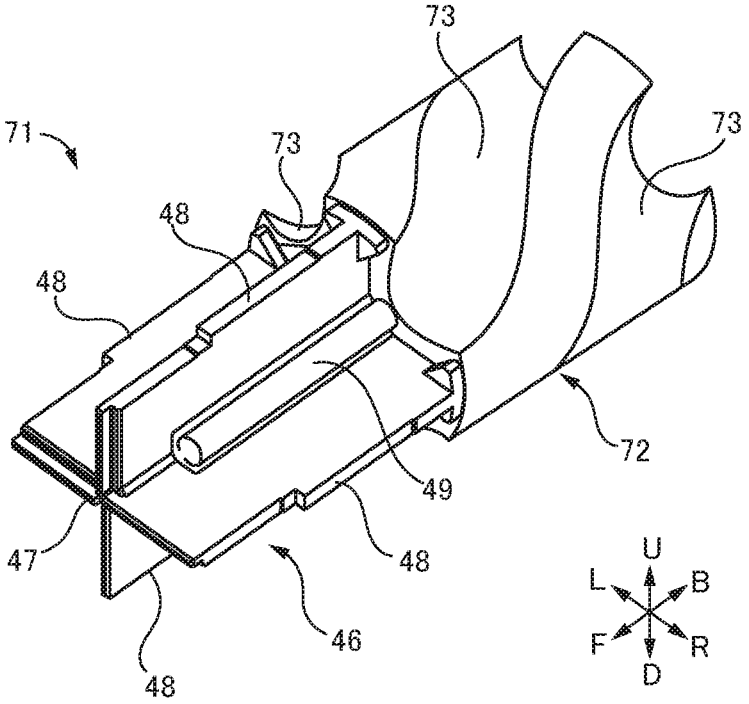
FIG. 12 is a perspective view showing a shield member of a connector according to another embodiment of the invention.

On the other hand, FIG. 11A shows a wire separation part 81 of a shield member of a connector in a comparative example. As shown in FIG. 11A, four wire separation walls 82 of the wire separation part 81 in the comparative example are not twisted, but extend linearly in the front and rear directions. As a result, a wire accommodating room 83 formed between the two wire separation walls 82 adjacent to each other extends linearly. FIG. 11B shows a state where the insulated wires 5 of the wire pairs 4 are disposed in the wire accommodating rooms 83 separately for each wire pair 4 without being warped. FIG. 11C shows a state where the insulated wires 5 of the wire pairs 4 are disposed in the wire accommodating rooms 83 for each wire pair 4 in a warped state.

In the comparative example, in a case where each insulated wire 5 has a suitable length, as shown in FIG. 11B, each insulated wire 5 of each wire pair 4 is disposed in the wire accommodating room 83 of the wire separation part 81 almost without being warped. In the comparative example, because each wire accommodating room 83 extends linearly, when each insulated wire 5 is disposed in each wire accommodating room 83 almost without being warped, the extending shape of each insulated wire 5 is linear. As a result, the distance between the insulated wires 5 forming each wire pair 4 is almost uniform from the front end to the rear end of the wire accommodating room 83, and the distance between the two wire pairs 4 adjacent to each other is almost uniform from the front ends to the rear ends of the wire accommodating rooms 83.

In the comparative example, if each insulated wire 5 is too long, as shown in FIG. 11C, each insulated wire 5 of each wire pair 4 is disposed in the wire accommodating room 83 of the wire separation part 81 with a warped state. In the comparative example, because each wire separation wall 82 extends linearly and thus each wire accommodating room 83 extends linearly, the extending shapes of the two insulated wires 5 forming each wire pair 4 are not formed such that the two insulated wires 5 are curved in the same direction as each other. As a result, there is a high possibility where the two insulated wires 5 forming each wire pair 4 are curved in different directions from each other in the shell 35. When the two insulated wires 5 forming each wire pair 4 are curved in different directions from each other, the distance between these insulated wires 5 is not uniform from the front end to the rear end of the wire accommodating room 83, and the distance between the two wire pairs 4 adjacent to each other is also not uniform from the front ends to the rear ends of the wire accommodating rooms 83. When uniformity of the distance between the two insulated wires 5 forming each wire pair 4 and uniformity of the distance between the wire pairs 4 are lost as described above, electric properties of the connector in the comparative example, such as an insertion loss and a reflection loss, may be deteriorated. According to the connector 21 in the embodiment of the present invention, it becomes possible to overcome the above disadvantages of the comparative example.

In the connector 21 in the embodiment of the present invention, the four wire separation walls 53 of the wire separation part 51 of the shield member 45 are twisted in the same direction, the four wire accommodating rooms 54 are thus twisted in the same direction, and then the extending shapes of the two insulated wires 5 forming each wire pair 4 are formed such that the two insulated wires 5 forming each wire pair 4 are curved in the same direction as each other in the shell 35. According to the configuration, at the attachment work of the cable 3 to the connector 21, a worker only needs to put the insulated wires 5 of the wire pairs 4 into the wire accommodating rooms 54 to form the extending shapes of the insulated wires 5 in such a manner that the two insulated wires 5 of each wire pairs 4 are curved in the same direction as each other. That is, it is easy for workers to form the extending shapes of the insulated wires 5 in such a manner that the two insulated wires 5 of each wire pairs 4 are curved in the same direction as each other. As described above, according to the connector 21 in the embodiment of the present invention, it becomes possible to achieve the connector 21 having excellent electric properties while ensuring easy attachment performance of the cable 3 to the connector 21. Additionally, by the configuration that the four wire separation walls 53 of the wire separation part 51 are twisted in the same direction, it becomes possible to provide a function of curving the two insulated wires 5 of each wire pair 4 in the same direction, to the shied member 45 without increasing in size of the shield member 45. Accordingly, it becomes possible to achieve a small size connector 21 having excellent electric properties.

In the connector 21 in the embodiment of the present invention, the twisting direction of each wire separation wall 53 is set to the same as the twisting direction of each wire pair 4 in the cable 3, and the twisting angle of each wire separation wall 53 per a unit length is set to almost the same as the twisting angle of each wire pair 4 per the unit length in the cable 3. According to the configuration, it becomes possible to make electric properties of the connector 21 close to electric properties of the cable 3 and to improve electric properties of the connector 21.

In the connector 21 in the embodiment of the present invention, the four terminal separation walls 48 made of electric conductive material separate the four terminal pairs 22 for each terminal pair 22, and the four wire separation walls 53 made of electric conductive material separate the four wire pairs 4 for each wire pair 4. According to the configuration, it becomes possible to suppress crosstalk between the terminal pairs 22 and crosstalk between the wire pairs 4.

The above embodiment shows an example where the wire separation part 51 of the shield member 45 includes the axial part 52 and the four wire separation walls 53 twisted from the front end to the rear end of the wire separation part 51. However, the present invention is not limited to the example. As the shield member of the connector of the present invention, a shield member 71 shown in FIG. 12 may be used, for example. The shield member 71 includes a wire separation part 72 with four wire accommodating grooves 73. The wire separation part is formed into a columnar shape extending in the front and rear directions. The four wire accommodating grooves 73 are formed on the outer circumferential face of the wire separation part 72. Each wire accommodating groove 73 extends in the front and rear directions. The four wire pairs 4 are disposed in the wire accommodating grooves 73 separately for each wire pair 4. The four wire accommodating grooves 73 are twisted in the same direction around the axial center of the shield member 71. According to the connector containing the shield member 71 having the above configuration, the same effect as the connector 21 in the above embodiment can be obtained.

The above embodiment shows an example where each wire separation wall 53 is twisted by 90 degrees from the front end to the rear end of the wire separation part 51. The present invention is not limited to the example. For example, the twisting angle may be changed into about 60 degrees, or 120 degrees. In a case where the twisting angle of each wire separation wall 53 per a unit length is made to be the same as the twisting angle of each wire pair 4 per the unit length in the cable 3, the length of the terminal separation part 46 in the front and rear directions is changed depending on the changed twisting angle.

The above embodiment shows an example where the twisting angle of each wire separation wall 53 per a unit length is made to be the same as the twisting angle of each wire pair 4 per the unit length in the cable 3. However, the twisting angle of each wire separation wall 53 per a unit length may not be made to be the same as the twisting angle of each wire pair 4 per the unit length in the cable 3.

The terminal separation part 46 and the wire separation part 51 of the shield member 45 in the above embodiment may be formed separately and may be formed by independent members. In this case, the terminal separation part 46 may be formed integrally with the fitting part 36 or the shell 35. Alternatively, the shell 35 may be formed into a rectangular cylindrical shape not but a circular cylindrical shape. The shell 35 and the fitting part 36 may be formed integrally. A connection way of the inner conductor 6 of the insulated wire 5 of the cable 3 to each terminal 23 is not limited to a crimping connection by caulking or a soldering. Another connection way, such as an insertion connection, can be used for it. An electric connection way of the braid 9 of the cable 3 to the shell 35 is not limited to the above way. The number of terminal pairs 22, the number of terminal holding pieces 29, the number of terminal separation walls 48 and the number of wire separation walls 53 of the connector 21 in the embodiment of the present invention may be two, three, five or more. To the connector 21 in the embodiment of the present invention, a UTP cable may be attached. The present invention may be adopted for a jack not but a plug.

The present invention may also be modified appropriately without departing from the content or the spirit of the invention which may be read from the claims and the entire specification, and electrical connectors with such modifications are also within the scope of the present invention.

The invention claimed is:

1. An electrical connector used for a cable including a plurality of wire pairs each including a pair of insulated wires, the electrical connector comprising:

a plurality of terminal pairs each including a pair of terminals and to which the wire pairs are attached;

a plurality of terminal holding pieces made of insulating material and each holding one of the plurality of terminal pairs;

an outer shell made of electric conductive material and formed into a cylindrical shape;

a fitting part disposed on one side in an axial direction in the outer shell to be fitted to a counter connector; and a shield member disposed in the outer shell and made of electric conductive material, wherein the shield member includes a plurality of terminal separation walls formed in one side in an axial direction in the shield member and extending radially from an axial center of the shield member, wherein the shield member includes a plurality of attachment parts each of which is formed between two of the terminal separation walls adjacent to each other, wherein each of the terminal holding pieces includes an engagement part and is fixed between two of the terminal separation walls adjacent to each other by engaging the engagement part with the attachment part, wherein the shield member includes a plurality of wire separation walls formed in another side in the axial direction in the shield member and twisted in a same direction around the axial center of the shield member, and wherein each of the wire pairs attached to the terminal pairs is disposed between two of the wire separation walls adjacent to each other such that one insulated wire and another insulated wire in each of the wire pairs are curved in a same direction as each other along the wire separation walls.

2. The electrical connector according to claim 1, wherein a twisting angle of each of the wire separation walls per a unit length is approximately equal to a twisting angle of each of the wire pairs per the unit length in the cable.

3. An electrical connector used for a cable including a plurality of wire pairs each including a pair of insulated wires, the electrical connector comprising:

a plurality of terminal pairs each including a pair of terminals and to which the wire pairs are attached;

a terminal holding part made of insulating material and holding the terminal pairs;

an outer shell made of electric conductive material and formed into a cylindrical shape, wherein the terminal holding part holding the terminal pairs is disposed on one side in an axial direction in the outer shell and the wire pairs attached to the terminal pairs are disposed on another side in the axial direction in the outer shell;

a fitting part disposed on said one side in the axial direction in the outer shell to be fitted to a counter connector; and a shield member disposed in the outer shell and made of electric conductive material, wherein the shield member separates the wire pairs for each wire pair in the outer shell, and forms extending shape of each of the wire pairs such that one insulated wire and another insulated wire in each of the wire pairs are curved in a same direction as each other, wherein the shield member is formed into a columnar shape extending in the axial direction of the outer shall, a plurality of accommodating grooves each extending in an axial direction of the shield member is formed on an outer circumferential face of the shield member, the wire pairs are disposed in the accommodating grooves separately for each wire pair, and the accommodating grooves are twisted in a same direction as each other around an axial center of the shield member.

4. The electrical connector according to claim 3, wherein a twisting angle of each of the accommodating grooves per a unit length is approximately equal to a twisting angle of each of the wire pairs per the unit length in the cable.

* * * * *